US008215591B2

(12) United States Patent
Roop

(10) Patent No.: US 8,215,591 B2
(45) Date of Patent: Jul. 10, 2012

(54) GUIDEWAY SWITCHING MECHANISM

(75) Inventor: Stephen S. Roop, College Station, TX (US)

(73) Assignee: The Texas A&M University System, College Station, TX (US)

( * ) Notice: Subject to any disclaimer, the term of this patent is extended or adjusted under 35 U.S.C. 154(b) by 245 days.

(21) Appl. No.: 12/248,813

(22) Filed: Oct. 9, 2008

(65) Prior Publication Data

US 2009/0095846 A1 Apr. 16, 2009

Related U.S. Application Data

(60) Provisional application No. 60/978,958, filed on Oct. 10, 2007.

(51) Int. Cl.
*E01B 7/00* (2006.01)

(52) U.S. Cl. ..... 246/415 R; 104/130.11

(58) Field of Classification Search ..... 104/130.11, 104/130.06; 246/430, 435 R, 442, 276
See application file for complete search history.

(56) References Cited

U.S. PATENT DOCUMENTS

| | | | | |
|---|---|---|---|---|
| 2,997,004 | A * | 8/1961 | Roseubaum et al. | 104/130.11 |
| 3,013,504 | A * | 12/1961 | Schutze | 104/130.11 |
| 3,095,827 | A * | 7/1963 | Chadenson | 104/130.01 |
| 3,310,004 | A * | 3/1967 | Chadenson | 104/130.09 |
| 3,472,176 | A * | 10/1969 | Trent | 104/130.11 |
| 5,292,091 | A * | 3/1994 | Callegari et al. | 246/258 |
| 5,620,156 | A * | 4/1997 | Berggren et al. | 246/221 |
| 6,499,701 | B1 * | 12/2002 | Thornton et al. | 246/194 |
| 6,543,727 | B2 * | 4/2003 | O'Brien et al. | 246/452 |
| 7,458,454 | B2 * | 12/2008 | Mendenhall | 198/463.2 |
| 7,484,695 | B2 * | 2/2009 | Cavalli | 246/415 R |
| 2002/0060273 | A1 * | 5/2002 | Schwiede | 246/452 |
| 2009/0095846 | A1 * | 4/2009 | Roop | 246/415 R |

FOREIGN PATENT DOCUMENTS

| | | |
|---|---|---|
| DE | 2148 697 A1 | 4/1973 |
| NL | 6 603 188 A | 6/1966 |

OTHER PUBLICATIONS

PCT Invitation to Pay Additional Fees and, where applicable, Protest Fee, (and partial International Search Report) regarding PCT Application No. US2008/079495 (5 pages), Jan. 28, 2009.

PCT Notification of Transmittal of the International Search Report and the Written Opinion of the International Searching Authority regarding PCT Application No. US2008/079495 (15 pages), Apr. 14, 2009.

The First Office Action issued by the State Intellectual Property Office of the People's Republic of China; Application No. 200880111164.4, Chinese Office Action and English translation, transmitted to Baker Botts L.L.P. Nov. 15, 2011, 19 pages, Nov. 15, 2011.

* cited by examiner

*Primary Examiner* — S. Joseph Morano
*Assistant Examiner* — Jason C Smith
(74) *Attorney, Agent, or Firm* — Baker Botts L.L.P.

(57) ABSTRACT

According to one embodiment, a guideway switching mechanism includes an elongated section of flexible guideway coupled to a switch plate. The flexible guideway has a first end that may be coupled to a first elongated guideway and a second end that may be selectively coupled to one of a multiple quantity of alternative guideways. The switch plate provides selective coupling of the flexible guideway to multiple alternative guideways by movement through an arcuate path such that the automated transport vehicle may selectively move from the first elongated guideway to either of the alternative guideways.

21 Claims, 4 Drawing Sheets

GUIDEWAY SWITCHING MECHANISM

RELATED APPLICATIONS

This application claims priority to U.S. Provisional Patent Application Ser. No. 60/978,958, entitled "GUIDEWAY SWITCHING MECHANISM," which was filed on Oct. 10, 2007.

TECHNICAL FIELD OF THE DISCLOSURE

This disclosure generally relates to guideway systems, and more particularly, to a guideway switching mechanism for a guideway system.

BACKGROUND OF THE DISCLOSURE

A guideway system generally refers to a type of transportation system in which automated transport vehicles are guided along predetermined paths using a guideway made of structurally rigid materials including metal and/or concrete. While typical railway systems use a pair of elongated steel rails that are spaced apart a specified distance from one another and configured to guide its associated transport vehicles using flange-shaped wheels, guideway systems utilize a single elongated guideway for guidance of its associated transport vehicles. The guideway provides guidance of the automated transport vehicle along specified paths and may include running surfaces for support of the wheels of the automated transport vehicle.

SUMMARY OF THE DISCLOSURE

According to one embodiment, a guideway switching mechanism includes an elongated section of flexible guideway coupled to a switch plate. The flexible guideway has a first end that may be coupled to a first elongated guideway and a second end that may be selectively coupled to one of a multiple quantity of alternative guideways. The switch plate provides selective coupling of the flexible guideway to multiple alternative guideways by movement through an arcuate path such that the automated transport vehicle may selectively move from the first elongated guideway to either of the alternative guideways.

Some embodiments of the disclosure may provide numerous technical advantages. Some embodiments may benefit from some, none, or all of these advantages. For example, according to one embodiment, flexible guideway may provide motive force the automated transport vehicle while moving through the guideway switching mechanism. This may be due, at least in part to the properties of the guideway that remain essentially continuous throughout the guideway switching mechanism. For linear induction motors, therefore, that generate motive force using the guideway, the automated transport vehicle may remain under power while transitioning through the guideway switching mechanism.

Other technical advantages may be readily ascertained by one of ordinary skill in the art.

BRIEF DESCRIPTION OF THE DRAWINGS

A more complete understanding of embodiments of the disclosure will be apparent from the detailed description taken in conjunction with the accompanying drawings in which.

DETAILED DESCRIPTION OF EXAMPLE EMBODIMENTS

Guideway systems incorporating a single elongated guideway may provide certain advantages over railway systems having multiple rails. For example, guideways may be used in conjunction with linear induction motors to provide a motive force for movement of transport vehicles along the guideway. Switching of the transport vehicle among multiple guideways or paths is not easily accomplished, however, due to their obstruction of the wheels of transport vehicle when extending in a path that is different from the chosen path of the transport vehicle.

Figure 1:
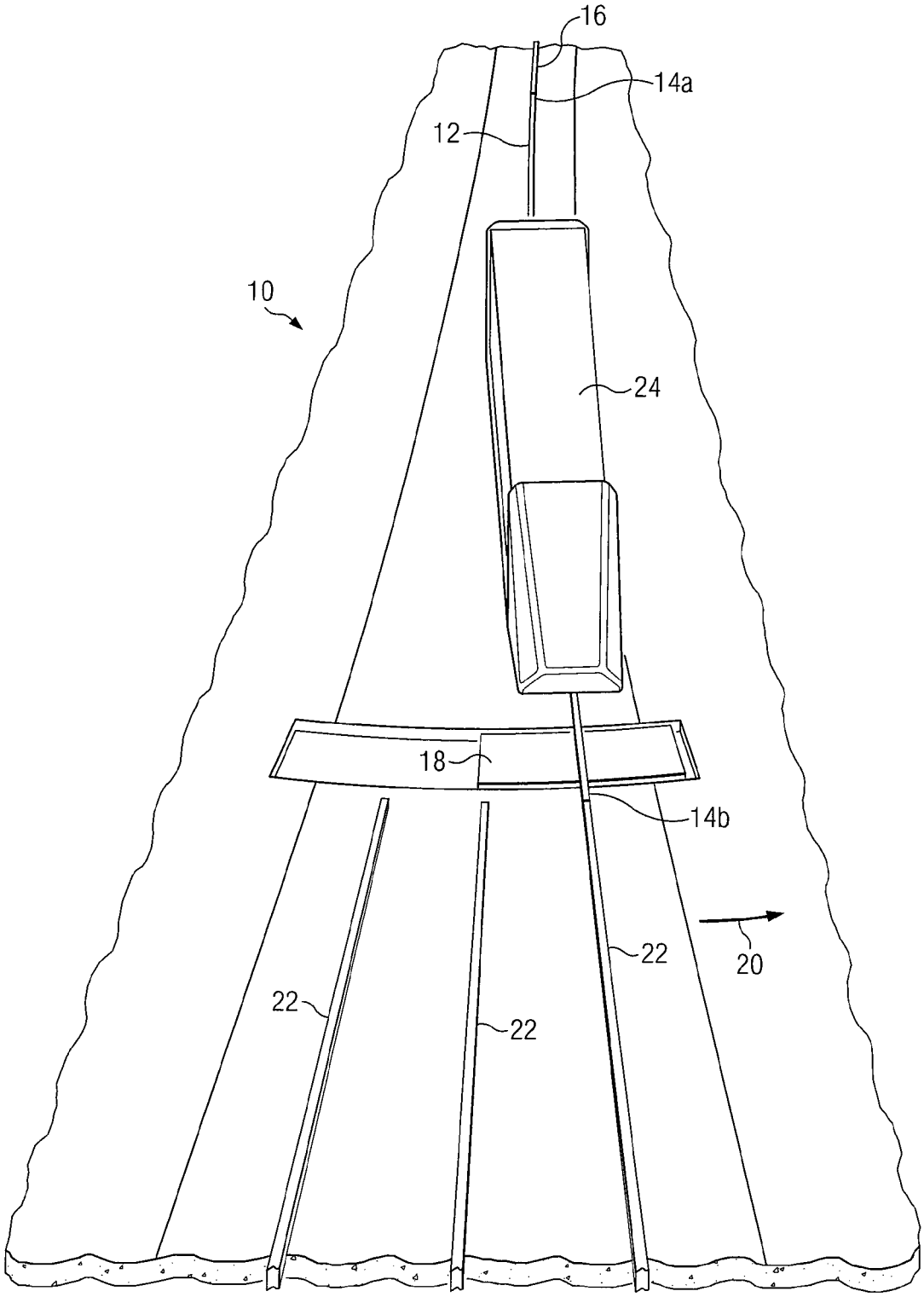
FIG. 1 is a perspective view of one embodiment of the guideway switching mechanism according to the teachings of the present disclosure.

FIG. 1 shows one embodiment of a guideway switching mechanism 10 that may provide a solution to this problem and other problems. Guideway switching mechanism 10 generally includes an elongated section of flexible guideway 12 having one end 14*a* that is coupled to a first elongated guideway 16 and a second end 14*b* coupled to a switch plate 18. According to the teachings of the present disclosure, flexible guideway 12 may bend along a generally horizontal arc 20 to selectively couple flexible guideway 12 to one of three alternative guideways 22*a*, 22*b*, or 22*c* such that automated transport vehicle 24 may selectively move from first guideway 16 to either of the three alternative guideways 22*a*, 22*b*, or 22*c*. In the particular embodiment shown, three alternative guideways 22*a*, 22*b*, and 22*c* are shown; however, guideway switching mechanism 10 may be configured to switch flexible guideway 12 among any quantity of alternative guideways 22 such as two, four, or more alternative guideways 22.

Automated transport vehicle 24 may be any type of vehicle suitable for movement along first guideway 16, alternative guideways 22*a*, 22*b*, and 22*c*, and flexible guideway 12. In one embodiment, motive force for movement of automated transport vehicle 24 may be provided by a linear induction motor (not specifically shown) in which first guideway 16, alternative guideways 22*a*, 22*b*, and 22*c*, and flexible guideway 12 serves as a stator portion of the linear induction motor. Certain embodiments of the present disclosure may provide an advantage in that the flexible guideway 12 may continue to provide motive force for automated transport vehicle 24 while transitioning through the guideway switching mechanism 10.

In one embodiment, guideway switching mechanism 10 may be implemented such that automated transport vehicle 24 diverges from one first guideway 16 to one of multiple alternative guideways 22*a*, 22*b*, or 22*c*. In another embodiment, guideway switching mechanism 10 may be implemented such that the automated transport vehicle 24 merges from multiple alternative guideways 22*a*, 22*b*, and 22*c* into a single first guideway 16. That is, the switching function of the guideway switching mechanism 10 may be reversed to provide a merging operation from among a plurality of alternative guideways 22*a*, 22*b*, and 22*c* as opposed to diverging from a single first guideway 16 to multiple alternative guideways 22*a*, 22*b*, and 22*c*.

Figure 2A:
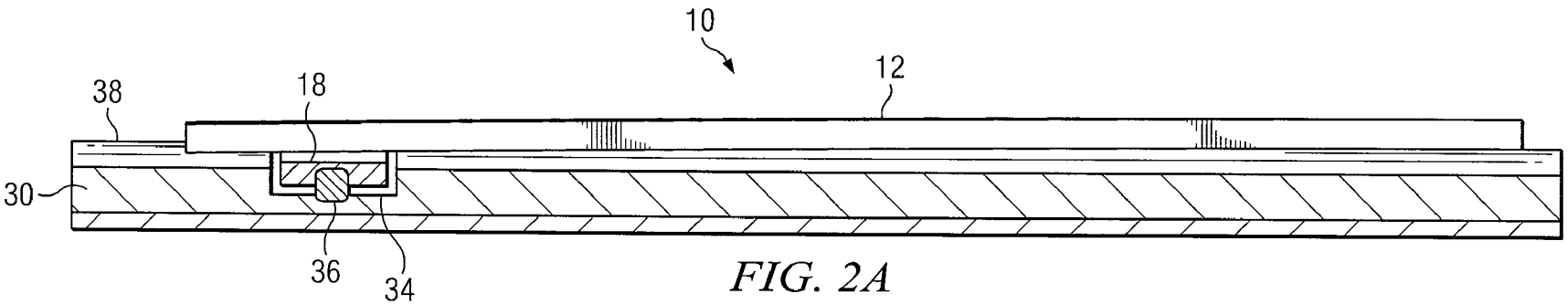
FIG. 2A is a cross-sectional, side elevational view of the guideway switching mechanism of FIG. 1.
Figure 2B:
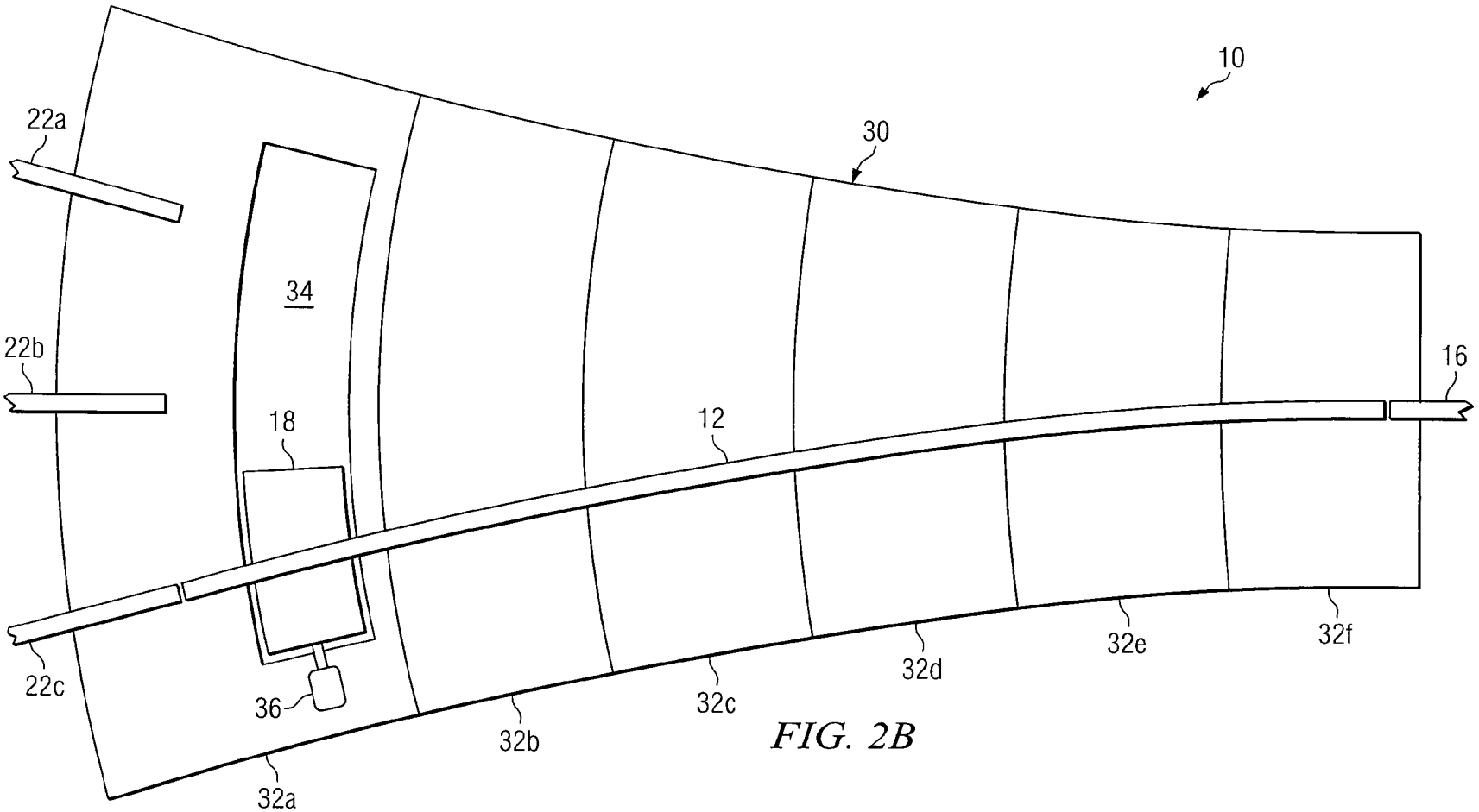
FIG. 2B is a top view of the guideway switching mechanism of FIG. 1.
Figure 2C:
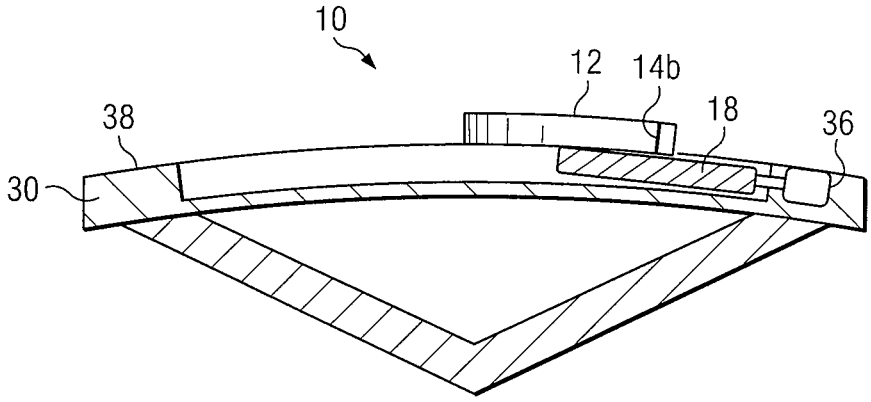
FIG. 2C is a cross-sectional, front elevational view of the guideway switching mechanism of FIG. 1.

FIGS. 2A through 2C show side elevational, top, and front elevational views, respectively, of guideway switching mechanism 10, which is formed in this embodiment, on a pre-fabricated support substrate 30. Pre-fabricated support substrate 30 may be made of any suitable material having sufficient strength for supporting the weight of a loaded automated transport vehicle 24 and support lateral forces through flexible guideway 12 for changing the direction of the automated transport vehicle 24. In one embodiment, support substrate 30 is made of concrete and may include various types of reinforcement material, such as wire mesh or rebar.

The term "pre-fabrication" may be referred to, in this disclosure, as the act of creating support substrate 30 at one location, and subsequently installing and using the created support substrate 30 at a different location. In one embodiment, guideway switching mechanism 10 may be fabricated in multiple sub-sections 32*a* through 32*f* (FIG. 2B). Each of these sub-sections 32*a* through 32*f* may be individually transported and subsequently assembled at a desired location of use. In one example, guideway switching mechanism 10 may be approximately twenty feet wide at it widest point and approximately 180 feet long. This guideway switching mechanism 10 may therefore, have six sub-sections 32*a* through 32*f* that are each approximately 30 feet long.

Bending of flexible guideway 12 may be provided by a switch plate 18. Switch plate 18 is disposed in a generally arc-shaped cavity 34 that allows the switch plate 18 to freely move in a generally lateral arcuate path. An actuator 36 may be provided for movement of the switch plate 18. The actuator 36 may be any suitable type, such as a hydraulic piston, a servo mechanism, or an electric motor.

The length of travel of the switch plate 18 may be based upon the quantity of alternative guideways 22*a*, 22*b*, and 22*c* implemented and the breadth of the wheels of automated transport vehicle 24. For example, to provide for clearance between the wheels of automated transport vehicle 24 and an adjacent alternative guideway 22*a*, 22*b*, or 22*c*, each alternative guideway 22*a*, 22*b*, and 22*c* may be placed at least half the wheel breadth of automated transport vehicle 24 apart.

The speed at which the actuator 36 is operable to alternatively couple alternative guideways 22*a*, 22*b*, and 22*c* may be directly proportional to the rate at which automated transport vehicles 24 move through guideway switching mechanism 10. In one embodiment, actuator 36 moves switch plate 18 at a speed of approximately 10 feet-per-second such that automated transport vehicles 24 moving at approximately 90 feet-per-second may be properly guided to their desired alternative guideway 22*a*, 22*b*, or 22*c*.

As best shown in FIG. 2C, support substrate 30 has an upper surface 38 with a convex shape. The convex shape of upper surface 38 may provide a banking angle or activity for automated transport vehicles 24 that are diverted from a straight trajectory due to bending of flexible guideway 12. In the present embodiment shown for example, diverting automated transport vehicle 24 to either alternative guideway 22*a* or 22*c* may be provided by bending flexible guideway 12. In this case, movement of automated transport vehicle 24 along flexible guideway 12 may impart lateral forces on automated guideway vehicle 24 due to centripetal momentum of automated transport vehicle 24. Banking provided by the convex shape of upper surface 38 in this case may reduce centripetal forces that may in turn, reduce the lateral force placed on flexible guideway 12 when automated transport vehicle is diverted onto guideway 22*a* or 22*c*.

Figure 3:
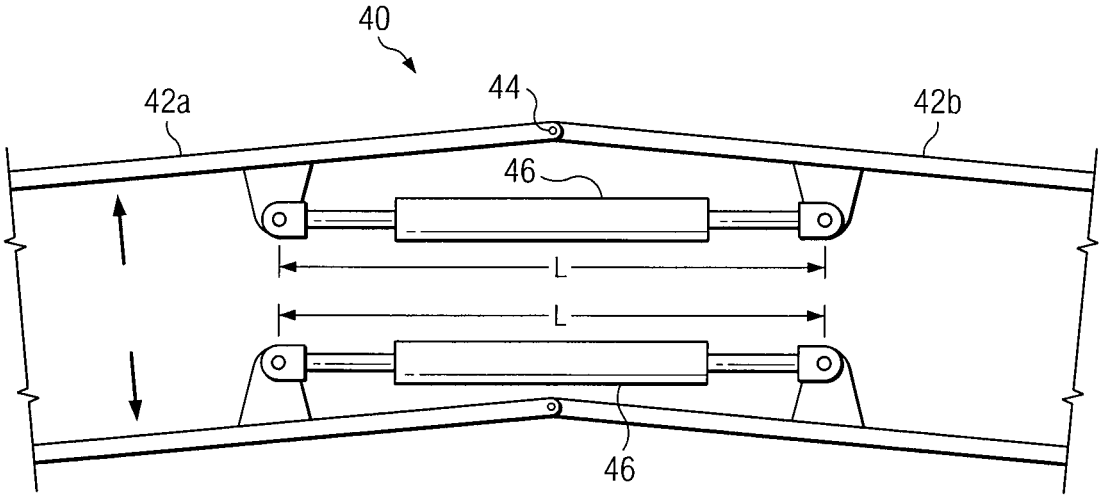
FIG. 3 is a partial diagram view of an alternative embodiment of a flexible guideway that may be used with the guideway switching mechanism of FIG. 1.

FIG. 3 shows a partial diagram view of an alternative embodiment of a flexible guideway 40 that may be used with the guideway switching mechanism 10 of FIG. 1. Whereas flexible guideway 12 of FIGS. 1 through 2C has a lateral flexibility that may be distributed uniformly from its first end 14*a* to its second end 14*b*, flexible guideway 40 has a plurality of rigid sub-sections 42*a* and 42*b* that are hingedly coupled together at relatively equally spaced apart intervals from its first end to second end. In the particular illustration shown, only two sub-sections 42*a* and 42*b* are shown; however, it should be understood that flexible guideway 40 may have any quantity of sub-sections 42*a* and 42*b* that are hingedly coupled together at regularly spaced intervals.

Lateral bending of rigid sub-sections 42*a* and 42*b* relative to one another may be provided by articulation along a joint 44. A multiple quantity of joints 44 configured on flexible guideway 40 allows it to bend along an arc for selectively coupling second end 14*b* to either of alternative guideways 22. The stiffness of joint 44 may also be controlled from a relatively low stiffness to allow bending to a relatively high stiffness for guiding automated transport vehicle 24 along its selected path.

Selective stiffness of joint 44 may be provided by any suitable approach. In the particular embodiment shown, two pistons 46 are included that are coupled at either end to adjacent sub-sections 42*a* and 42*b*. Pistons 46 have a length L that varies proportionally with articulation of joints 44 and have an adjustable stiffness. The stiffness of pistons 46 generally refers to their level of resistance to a change in its length L. Thus, by controlling the stiffness of pistons 46, the relative stiffness of joint 44 is effectively controlled. In the particular embodiment shown, two pistons 46 are used to control the stiffness of joint 44; however, any quantity of pistons 46, such as one piston, or three or more pistons may be used to control the stiffness and thus lateral articulation of their associated joint 44.

In one embodiment, pistons 46 may be filled with a magneto Theological fluid to control its stiffness. A magneto Theological fluid is a substance having a viscosity that varies according to an applied magnetic field. Typical magneto Theological fluids include ferro-magnetic particles that are suspended in a carrier fluid, such as mineral oil, synthetic oil, water, or glycol, and may include one or more emulsifying agents that maintain suspension of these ferro-magnetic particles in the carrier fluid. Pistons 46 may operate, therefore, in the presence of a magnetic field to control the stiffness of pistons 46 and thus, the stiffness of joint 44 to which they are coupled.

Modifications, additions, or omissions may be made to guideway switching system 10 without departing from the scope of the disclosure. The components of guideway switching system 10 may be integrated or separated. For example, flexible guideway 12 may be integrally formed with switch plate 18 such that actuator 36 is directly coupled to flexible guideway 12. Moreover, the operations of guideway switching system 10 may be performed by more, fewer, or other components. For example, support substrate 30 may include other structural features not specifically described to support the weight of automated transport vehicle 24 and/or maintain flexible guideway 40 in proper alignment with first elongated guideway 16 and alternative guideways 22. Additionally, operations of actuator 36 and/or pistons 46 may be controlled by a suitable controller that may include, for example, logic comprising software, hardware, and/or other suitable forms of logic. As used in this document, "each" refers to each member of a set or each member of a subset of a set. Additionally, the drawings are not necessarily drawn to scale.

Although the present disclosure has been described with several embodiments, a myriad of changes, variations, alterations, transformations, and modifications may be suggested to one skilled in the art, and it is intended that the present disclosure encompass such changes, variations, alterations, transformation, and modifications as they fall within the scope of the appended claims.

What is claimed is:

1. A guideway switching mechanism comprising:

an elongated section of flexible guideway having a first end and a second end, the first end operable to be coupled to a first elongated guideway;

a switch plate coupled to the flexible guideway proximate the second end and operable to bend the flexible guideway through a horizontally oriented arc for selectively coupling the second end to two or more second elongated guideways such that an automated transport vehicle may be guided by the elongated section from the first elongated guideway to either of the two or more second elongated guideways; and a support substrate for support of the elongated section of flexible guideway and the automated transport vehicle, the support substrate having an upper surface that is coupled to the first end and a cavity for placement of the switch plate, the cavity having an arc-like shape such that the switch plate may freely move along the horizontally oriented arc, the support substrate formed of a plurality of sub-sections that are joined together such that each of the plurality of sub-sections is disposed adjacent to at least one other of the plurality of sub-sections to form a continuous support substrate for supporting the elongated section of flexible guideway between the first end to the second end the upper surface of the support substrate having a lateral extent generally normal to the extent of the flexible guideway that has a convex shape.

2. The guideway switching mechanism of claim 1, wherein the flexible guideway has a lateral flexibility that is distributed uniformly from its first end to its second end.

3. The guideway switching mechanism of claim 1, wherein the flexible guideway comprises a plurality of rigid sub-sections that are hingedly coupled together at equally spaced apart intervals from the first end to the second end, each rigid sub-section is coupled to an adjacent rigid sub-section with a piston that is operable selectively adjust a lateral flexibility of the adjacent rigid sub-section relative to the each rigid sub-section from a generally flexible state to a generally rigid state.

4. A guideway switching mechanism comprising:

an elongated section of flexible guideway having a first end and a second end, the first end operable to be coupled to a first elongated guideway;

a support substrate for support of the automated transport vehicle, the support substrate being formed of a plurality of sub-sections that are joined together to form a continuous support substrate for supporting the elongated section of flexible guideway between the first end to the second end, the support substrate having an upper surface having a lateral extent generally normal to the extent of the flexible guideway, the upper surface having a convex shape; and a switch plate coupled to the flexible guideway proximate the second end and operable to bend the flexible guideway through a horizontally oriented arc for selectively coupling the second end to two or more second elongated guideways such that an automated transport vehicle may be guided by the elongated section from the first elongated guideway to either of the two or more second elongated guideways.

5. The guideway switching mechanism of claim 4, wherein the switch plate is further operable to bend the flexible guideway through the horizontally oriented arc such that the automated transport vehicle may be guided by the elongated section from either of the two or more second elongated guideways to the first elongated guideway.

6. The guideway switching mechanism of claim 4, wherein the upper surface is coupled to the first end and a cavity for placement of the switch plate, the cavity having an arc-like shape such that the switch plate may freely move along the horizontally oriented arc.

7. The guideway switching mechanism of claim 6, wherein the support substrate is essentially made of concrete.

8. The guideway switching mechanism of claim 6, wherein the plurality of sub-sections are operable to be joined together at a desired location of use.

9. The guideway switching mechanism of claim 6, wherein the switch plate is moved through the horizontally oriented arc using an actuator that is selected from the group consisting of a hydraulic piston, a servo mechanism, and an electric motor.

10. The guideway switching mechanism of claim 4, wherein the flexible guideway is operable to be used in conjunction with a linear induction motor.

11. The guideway switching mechanism of claim 4, wherein the flexible guideway has a lateral flexibility that is distributed uniformly from its first end to its second end.

12. The guideway switching mechanism of claim 4, wherein the flexible guideway comprises a plurality of rigid sub-sections that are hingedly coupled together at equally spaced apart intervals from the first end to the second end.

13. The guideway switching mechanism of claim 12, wherein each rigid sub-section is coupled to an adjacent rigid sub-section with a piston that is operable selectively adjust a lateral flexibility of the adjacent rigid sub-section relative to the each rigid sub-section from a generally flexible state to a generally rigid state.

14. The guideway switching mechanism of claim 13, wherein the piston comprises a magneto rheostatic fluid having a viscosity that is selectively adjustable from a low viscosity to a high viscosity under the influence of a magnetic field.

15. A method comprising:

moving an automated transport vehicle along a first elongated guideway that has a first end and a second end and is coupled to a flexible guideway at the first end;

forming a support substrate from a plurality of sub-sections that are joined together to form a continuous support substrate for supporting the first elongated guideway between the first end to the second end;

supporting the flexible guideway on the support substrate having an upper surface having a lateral extent generally normal to the extent of the flexible guideway, the upper surface having a convex shape;

bending the flexible guideway through a horizontally oriented arc to couple its second end to one of a plurality of second elongated guideways; and traversing the flexible guideway, by the automated transport vehicle, to proceed along the one second elongated guideway.

16. The method of claim 15, further comprising moving the automated transport vehicle along the second elongated guideway and traversing the flexible guideway, by the automated transport vehicle, to proceed along the first elongated guideway.

17. The method of claim 15, further comprising transporting the plurality of sub-sections to their desired location of use and coupling the plurality of sub-sections together, the support substrate coupled to the flexible guideway at its first end.

18. The method of claim 17, wherein bending the flexible guideway further comprises bending the flexible guideway using an actuator that is selected from the group consisting of a hydraulic piston, a servo mechanism, and an electric motor.

19. The method of claim 15, further comprising moving the automated transport vehicle along the flexible guideway using a linear induction motor, the flexible guideway comprising a stator portion of the linear induction motor.

20. The method of claim 15, wherein bending the flexible guideway through a horizontally oriented arc further comprises bending the flexible guideway comprising a plurality of rigid sub-sections that are hingedly coupled together at equally spaced apart intervals from the first end to the second end, each rigid sub-section being coupled to an adjacent rigid sub-section with a piston, and increasing the stiffness of the piston to increase the stiffness of each rigid sub-section to its adjacent rigid sub-section.

21. The method of claim 20, wherein the piston comprises a magneto rheostatic fluid having a viscosity that is selectively adjustable from a low viscosity to a high viscosity under the influence of a magnetic field.

* * * * *